US010231496B1

(12) United States Patent
Glassner

(10) Patent No.: US 10,231,496 B1
(45) Date of Patent: Mar. 19, 2019

(54) DEPLOYABLE RAIN PANTS

(71) Applicant: Dovid Leib Glassner, Brooklyn, NY (US)

(72) Inventor: Dovid Leib Glassner, Brooklyn, NY (US)

( * ) Notice: Subject to any disclaimer, the term of this patent is extended or adjusted under 35 U.S.C. 154(b) by 0 days.

(21) Appl. No.: 15/887,553

(22) Filed: Feb. 2, 2018

Related U.S. Application Data

(63) Continuation-in-part of application No. 14/825,628, filed on Aug. 13, 2015, now abandoned.

(51) Int. Cl.
*A41D 1/06* (2006.01)
*A41D 17/02* (2006.01)

(52) U.S. Cl.
CPC ..... *A41D 17/02* (2013.01); *A41D 1/06* (2013.01); *A41D 2300/33* (2013.01); *A41D 2400/422* (2013.01); *A41D 2400/424* (2013.01)

(58) Field of Classification Search
CPC ..... A41D 1/06; A41D 17/02; A41D 2400/422
USPC ..... 2/227, 228, 247, 69, 71, 79, 46
See application file for complete search history.

(56) References Cited

U.S. PATENT DOCUMENTS 2,483,136 A 9/1949 Hamman et al.
4,458,363 A 7/1984 Harvey
4,984,303 A 1/1991 Ross
5,008,962 A 4/1991 Smith et al.
5,561,865 A * 10/1996 Fjelstul ..... A41D 1/06 2/227
5,822,802 A 10/1998 Chou
6,108,815 A 8/2000 Majerfeld
6,336,226 B1 * 1/2002 Garcia ..... A41D 15/04 2/227
6,360,370 B1 * 3/2002 Ferreras ..... A41D 3/04 2/69
D469,241 S 1/2003 Moore
2001/0004771 A1 6/2001 Chou
2004/0069827 A1 * 4/2004 Stewart ..... A45F 4/00 224/577
2007/0083985 A1 * 4/2007 Nathan ..... A41B 9/001 2/400
2009/0070910 A1 3/2009 McNally et al.
2012/0152772 A1 6/2012 Garner
(Continued)

FOREIGN PATENT DOCUMENTS

EP 0071226 9/1983
WO WO09923901 5/1999
WO WO03053184 7/2003

*Primary Examiner* — Katherine M Moran
(74) *Attorney, Agent, or Firm* — Goldstein Law Offices, P.C.

(57) ABSTRACT

A deployable rain pants assembly, for use by a user having a waist and legs in protecting everyday pants from the rain, including a belt and a pants portion. The pants portion is initially stored near the belt, which is worn around the waist until needed. The pants portion has a top edge, a bottom edge having ankle openings, a pair of pant leg portions, and a waist band having a waist band front and a waist band rear. A pair of main seams extend from near the bottom edge to the waistband and selectively join the pant leg parts, and join the waist band front and waist band rear. Once the pants portion is deployed downwardly from the belt, the waist band rear is tucked between the legs, the user steps through the ankle openings, and main seams are joined to encase and cover the everyday pants.

11 Claims, 11 Drawing Sheets

(56) References Cited

U.S. PATENT DOCUMENTS

| | | | | |
|---|---|---|---|---|
| 2014/0373246 | A1* | 12/2014 | Chapuis | A41D 1/00 2/69 |
| 2018/0049489 | A1* | 2/2018 | Noll | A41D 3/00 |

* cited by examiner

DEPLOYABLE RAIN PANTS

CROSS REFERENCES AND RELATED SUBJECT MATTER

This application is a continuation-in-part of patent application Ser. No. 14/825,628, filed in the United States Patent Office on Aug. 13, 2015, which is incorporated by reference herein in its entirety.

TECHNICAL FIELD

The present disclosure relates generally to deployable rain pants. More particularly, the present disclosure relates to pants that quickly and easily deploy downwardly from the waist without requiring the removal of footwear.

BACKGROUND

Sports enthusiasts and nature lovers engage in a wide variety of outdoor activities. Along with the enjoyment of being outdoors, however, comes the possibility of sudden inclement weather.

Getting caught in an extreme downpour can be unpleasant and unhealthy. When hiking, mountain climbing, cycling, and engaging in similar activities, it is not uncommon to be miles or hours from shelter. Accordingly, protective gear must be carried to avoid having even a short downpour ruin your day.

Rain pants are typically made of a waterproof material, and are donned over existing pants or shorts. Putting on rain pants usually requires that the user step into each pant leg with each foot, and have each foot exit through an ankle opening. While engaging in outdoor activities, however, the user will typically be wearing footwear and possibly heavy boots. Most footwear will not fit through the ankle openings provided by typical rain pants.

Thus, suddenly having to put on rain pants, then, might require the user to remove his footwear, and step on the bare (and probably wet) ground. While the user might thereafter avoid getting his legs wet due to protection from the rain pants, he must, however, suffer through the day with wet feet, socks, and shoes.

In addition, under most circumstances, rain gear will need to be removed from one's backpack or gear, and be unpacked and unfolded. Doing so might require two free hands, and depending on the activity currently engaged in, might require more dexterity and attention than is currently available or possible to offer. Also, in the time it takes to get the rain gear out, ready, and on—the user might already be soaked from the rain.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide rain pants that are easily deployed without requiring that the user remove footwear. Accordingly, the present disclosure provides rain pants that initially fasten around the waist with a waist belt, has a pants portion that rolls down from the waist belt toward the ankles, provide a wide opening that the user can step into, and then fasten around the legs.

It is another aspect of an example embodiment in the present disclosure to provide rain pants that are lightweight and unobtrusive, yet convenient to use when needed. Accordingly, the waist belt contains a storage pouch, and a waist band front of the pants portion are attached to the inside of the storage pouch so that the pants portion folds neatly into the pouch for storage, and rolls out quickly for use.

It is yet another aspect of an example embodiment in the present disclosure to provide rain pants that are easy to deploy. Accordingly, the pants portion includes a pair of pants parts and a central portion. The pants parts include a waist band front and a waist band rear. A pair of main seams connect and quickly join each of the pants parts with the central portion, fully between the top and bottom of the pants portion. Waist band fasteners may be employed to join the waist band front to the waist band rear prior to joining the seams to facilitate donning the rain pants.

Accordingly, the present disclosure describes a deployable rain pants assembly, for use by a user having a waist and legs in protecting everyday pants from the rain, including a belt and a pants portion. The pants portion is initially stored near the belt, which is worn around the waist until needed. The pants portion has a top edge, a bottom edge having ankle openings, a pair of pant leg portions, and a waist band having a waist band front and a waist band rear. A pair of main seams extend from near the bottom edge to the waistband and selectively join the pant leg parts, and join the waist band front and waist band rear. Once the pants portion is deployed downwardly from the belt, the waist band rear is tucked between the legs, the user steps through the ankle openings, and main seams are joined to encase and cover the everyday pants.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
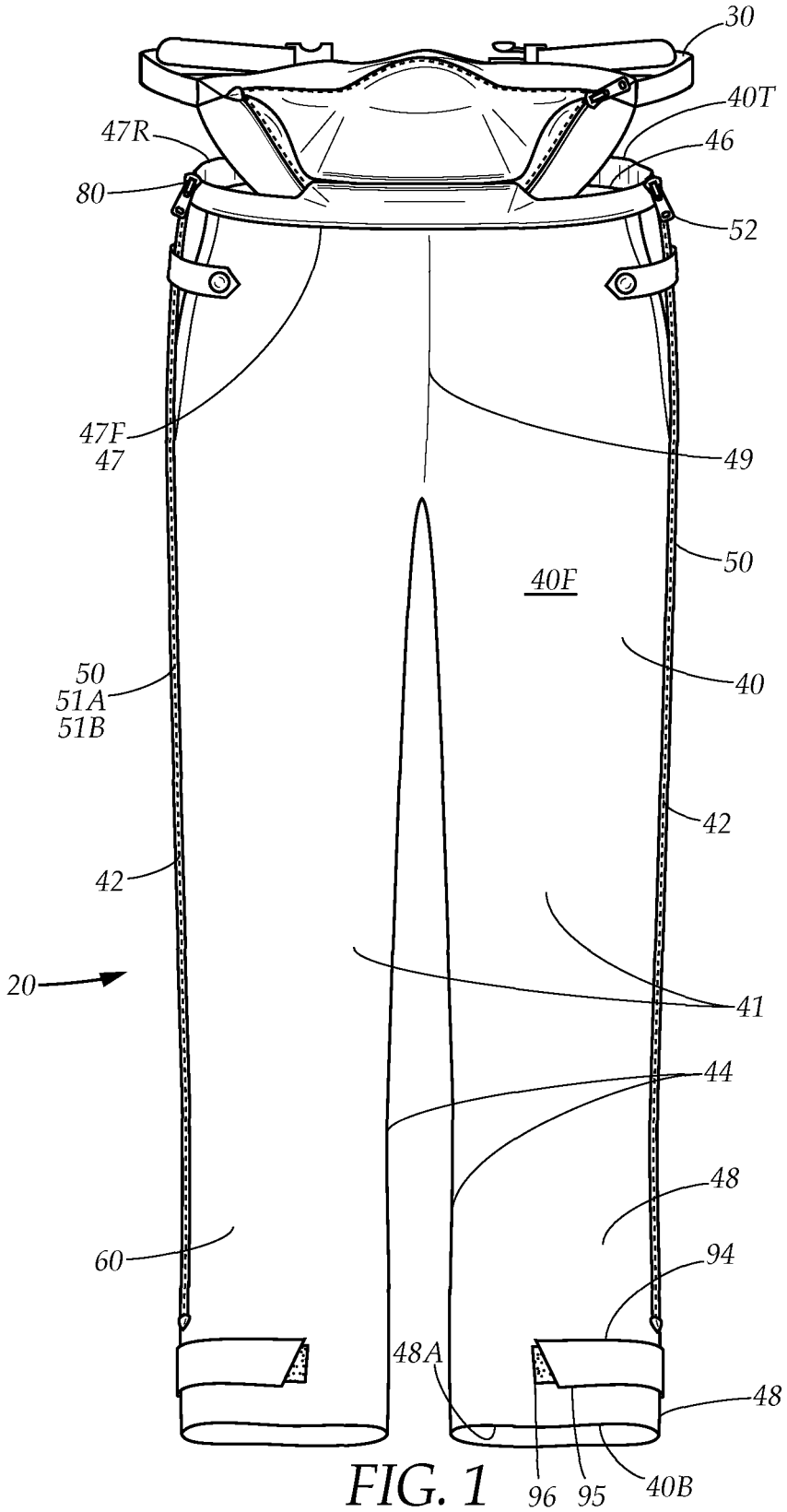
FIG. 1 is front elevational view of deployable pants in accordance with the present disclosure, with the main seams fastened.
Figure 2:
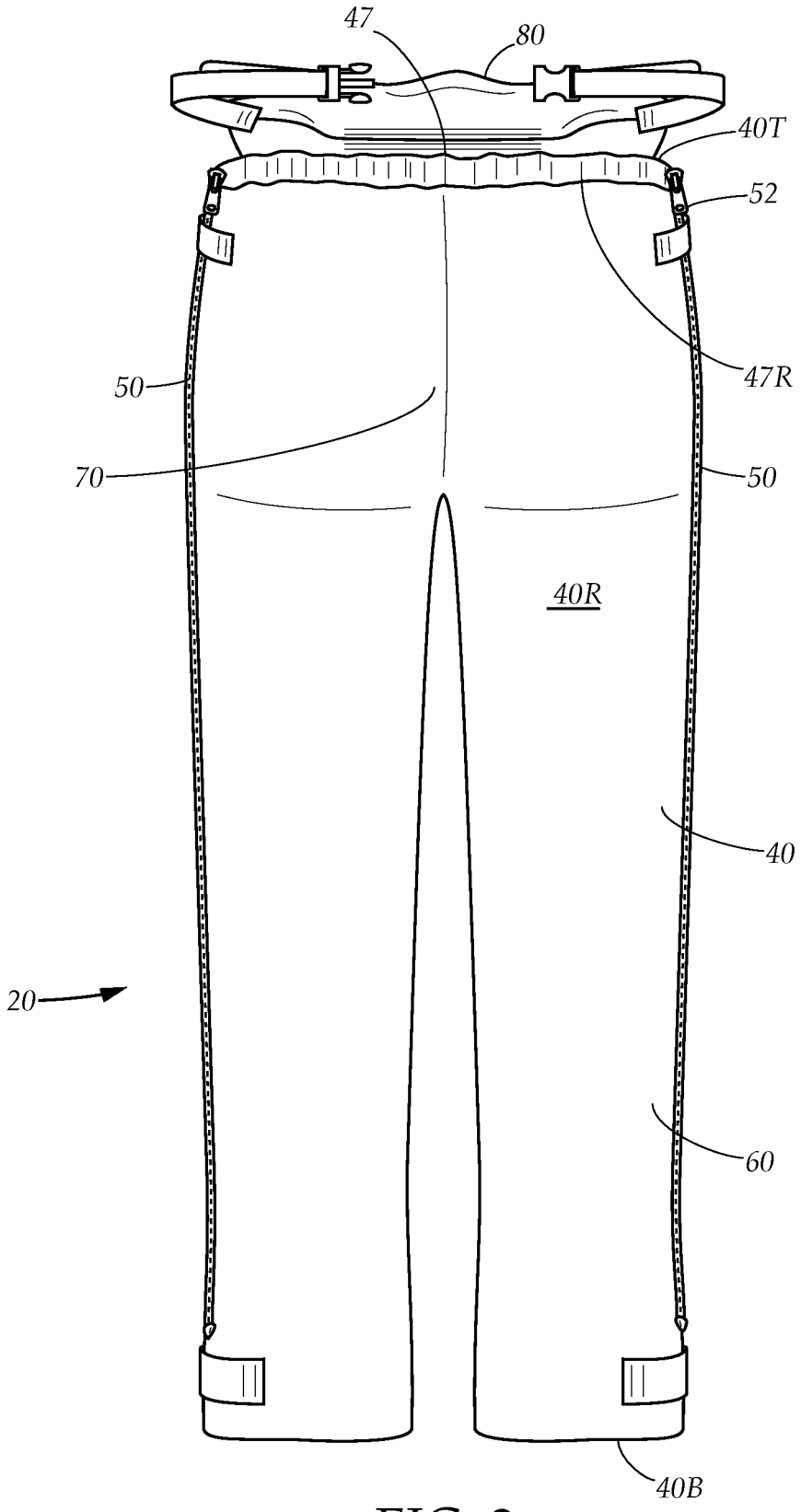
FIG. 2 is a rear elevational view thereof.
Figure 3:
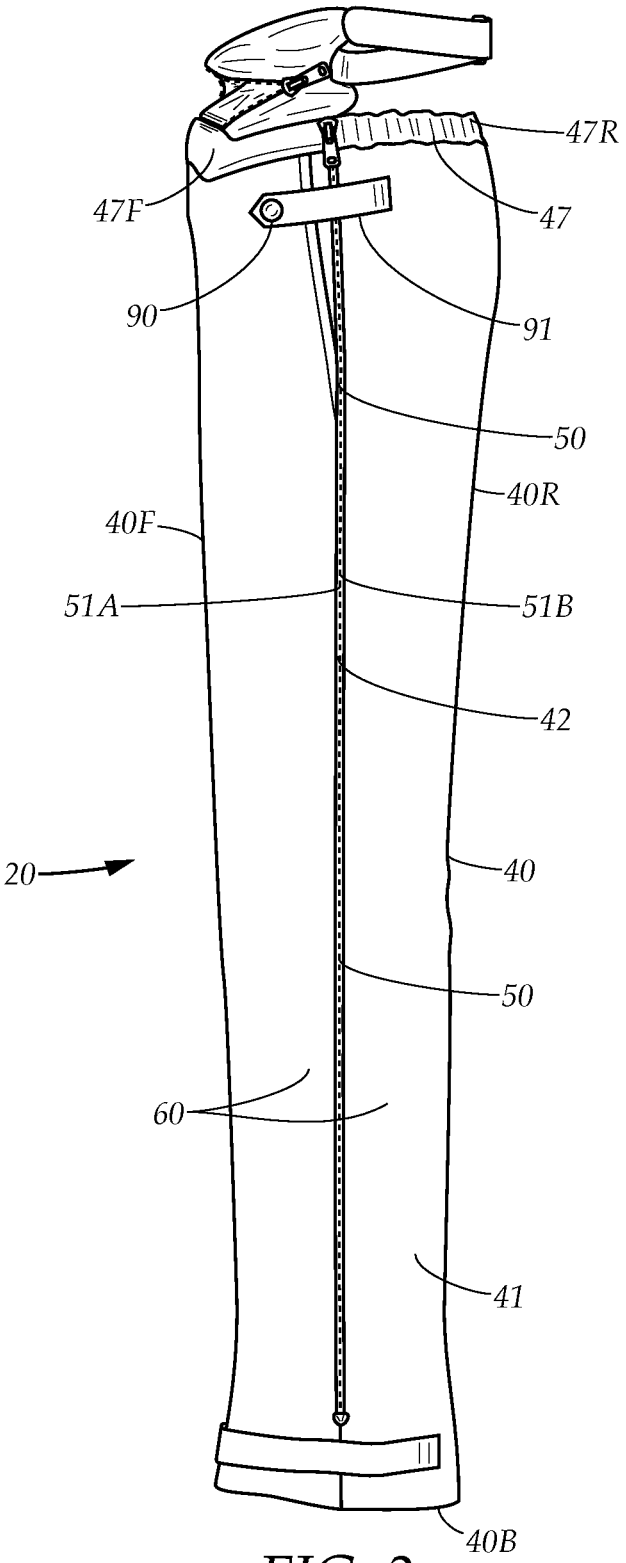
FIG. 3 is a side elevational view thereof.
Figure 4:
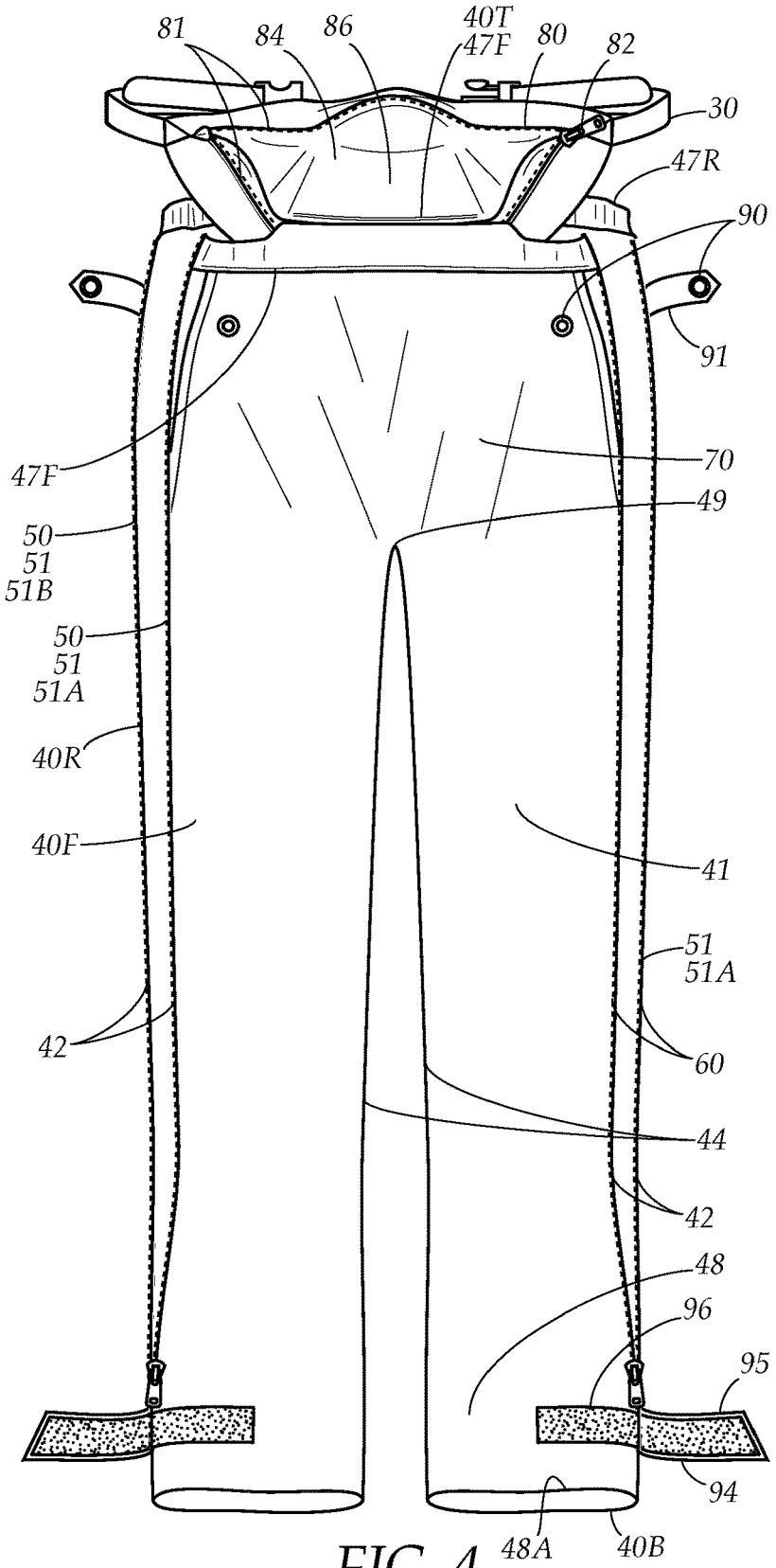
FIG. 4 is a front elevational view thereof, wherein the main seams are open.

FIGS. 1, 2, and 3 illustrate a deployable rain pant assembly 20, having a belt 30, a pouch 80, and a pants portion 40. The pants portion 40 includes a top edge 40T, a bottom edge 40B, a front 40F, and a rear 40R. The pants portion 40 also includes two pants legs 41, each pant leg 41 having an outer edge 42 and an inside edge 44. The outer edges 42 of the pant legs 41 face away from each other, and the inside edges 44 face toward each other. At the top edge 40T is a waistband 47 defining a waist opening 46, and an inseam 49 that extends downwardly from the waist opening 46, and between the pant legs 41. The waist band 47 includes a selectively attachable and detachable waist band front 47F and waist band rear 47R that when joined together are continuous to form the waist opening 46. The inseam 49 fixedly connects the waist band front 47F and waist band rear 47R. At the bottom edge 40B, on each pant leg 41, is a cuff 48 defining an ankle opening 48A. The waist band front 47F is secured to the pouch 80, as will be described in further detail hereinbelow. Referring momentarily to FIG. 1 and FIG. 4, the cuff 48 may be flared to be wider than other portions of the pant leg 41 to not only be more comfortable while wearing boots, but also to allow the boots to extend through the ankle opening 48A so that footwear does not need to be removed while donning the deployable rain pant assembly, as described in further detail hereinbelow. Accordingly, each pant leg may have a cuff strap assembly 94 near the bottom edge 40B. Each cuff strap assembly 94 includes a cuff strap 95, and a cuff fastener 96 that may be selectively joined with the cuff strap 95, to tighten the pant leg 41 near the bottom edge 40B.

Referring again to FIG. 1, FIG. 2, and FIG. 3, in accordance with principles of the present disclosure, the pants portion 40 has a pair of main seams 50, each associated with one of the pant legs 41. In particular, each main seam 50 starts near the bottom 40B at one of the outer edges 42 and extends upwardly therefrom, fully to the top edge 40T where it separates the waist band front 47F and waist band rear 47R. In simple terms, when worn, the main seams 50 each extend substantially from an ankle of a user to an adjacent hip of that user.

The main seams 50 selectively join adjacent fabric portions which make up the pants portion 40, and will be described in further detail hereinbelow. The main seams 50 are capable of fully separating along their length, and are capable of fully joining along their length. Accordingly, a main seam fastener is provided along each main seam 50. In particular, a main zipper 52 extends fully along each main seam to facilitate attachment and detachment of adjacent fabric portions therealong.

Referring to FIGS. 3 and 4, while the pants portion 40 has an irregular shape, it is generally a single, continuous piece. Accordingly, the following discussion regarding components thereof is not absolute, as many of the components continue and transition into the other components. For example, the pants portion 40 includes a pair of pant leg parts 60 and a central portion 70. Consider that the central portion 70, however, arises as an intermediate area between the pant leg parts 60.

Each pant leg part 60 is generally at the front 40F or rear 40R of the pants portion 40 and is permanently joined to the other pant leg part 60 at the bottom edge 40B of each of the pant legs 41. The pant leg parts 60 are permanently attached along the inside edges 44 of each pant leg 41 and at the central portion 70 along the inseam 49 and are only detached or detachable along the outer edges 42 and between the waist band front 47F and waist band rear 47R.

The main seams 50 are defined by main seam edges 51. Each main seam edge 51 contains a component of the main seam fasteners that joins together to form the main seams 50. The main seams edges 51 are the adjacent fabric portions that are selectively joined by the main seam fasteners to form the main seams 50. For each main seam 50, the main seam edges 51 include a front outer seam edge 51A and a rear outer seam edge 51B. Each outer seam edge 51A, 51B extends between the bottom edge 40B of one of the pant legs 41 and the waist band 47. In fact, the waist band front 47F is defined and bounded by the front outer seam edges 51A, and the waist band rear 47R is defined and bounded by the rear outer seam edges 51B.

In accordance with the principles of the present disclosure, when the front outer seam edges 51A are joined with the rear outer seam edges 51B, the waist band front 47F is effectively joined to the waist band rear 47R to create a continuous waist band 47, as seen in FIG. 1 and FIG. 2. Further, the cuffs 48 are each continuous to define their ankle openings 48A. Still further, the pant leg parts 60 and central portion 70 define the pant legs 41 that fully cover the user, and protect the pants worn thereby, from ankles to waist.

Referring to FIG. 4, to help the user to quickly don the pants portion 40, it is advantageous to temporarily hold the waist band front 47F and waist band rear 47R together. Accordingly, waist band fasteners 90 are provided on both the waist band front 47F and waist band rear 47R, immediately adjacent to the seam 50, to hold the front outer seam edge 51A and rear outer seam edges 51B together. These fasteners 90 may be mating, snap type fasteners or the like. One of these fasteners 90 may be located on a fastener strap 91 that is attached adjacent the front outer seam edge 51A or rear outer seam edge 51B. The waist band fasteners 90 are provided adjacent to the main seams 50 where the waist band front 47F meets the front outer seam edges 51A, and where the waist band rear 47R meets the rear outer seam edges 51B. Securing the waist band fasteners 90 on the waist band front 47F to the waist band fasteners 90 on the waist band rear 47R essentially forms the waist band front 47F and waist band rear 47R into a continuous waist band around the user. Then the user can reach down toward the ankles and fasten the main seams 50 upwardly until they essentially reach the waist band.

Figure 5:
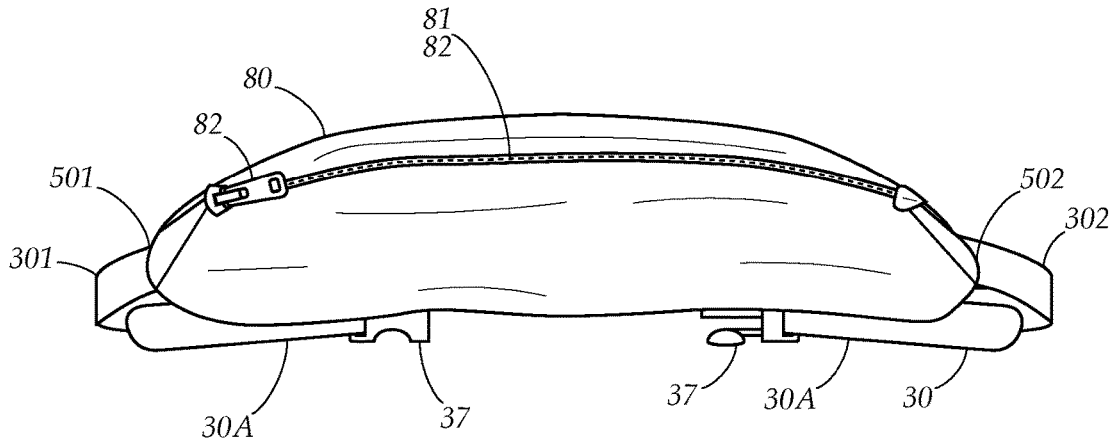
FIG. 5 illustrates the deployable pants with the pants portion fully encased within the storage pouch.

Referring to FIGS. 4 and 5, the storage pouch 80 is provided for neatly storing the pants portion. The storage pouch 80 is attached to the belt 30. In particular, the storage pouch 80 may have a first end 501 and a second end 502, the belt 30 may include a first belt part 301 and a second belt part 302. The first belt part 301 may be attached to the first end 501 with the second belt part 302 attached to the second end 502 of the pouch 80. Accordingly, the first belt part 301, second belt part 302, and pouch 80 form a selectively closeable continuous loop for encircling the user at the waist. Alternatively, the belt 30 may be one piece, itself selectively creating a continuous loop, with the pouch attached thereto.

The storage pouch 80 has a pouch opening 81, a pouch closure 82, and a pouch interior 84 that is capable of storing the pants portion 40 fully within the pouch interior 84. The pouch closure 82 selectively opens and closes the pouch opening 81. Accordingly, as illustrated the pouch closure 82 may be a zipper that extends along the pouch opening 81 to selectively mate edges thereof. The pouch 80 has an interior surface 86 within the pouch interior 84 that is only accessible when the pouch is open. The waist band front 47F at the top edge 40T of the pants portion 40 is secured to the interior surface 86 of the pouch 80. Accordingly, with this configuration the pants portion 40 may be fully stored within the pouch interior 84 while remaining attached to the pouch 80.

Referring again to FIG. 5, the pants portion 40 (not shown) is fully stored within the pouch 80. In addition, the belt 30 has a pair of ends 30A, and a buckle assembly having a pair of mating buckles 37 located near the ends 30A for selectively fastening the belt 30 around a person, as will be described directly hereinbelow.

Figure 6:
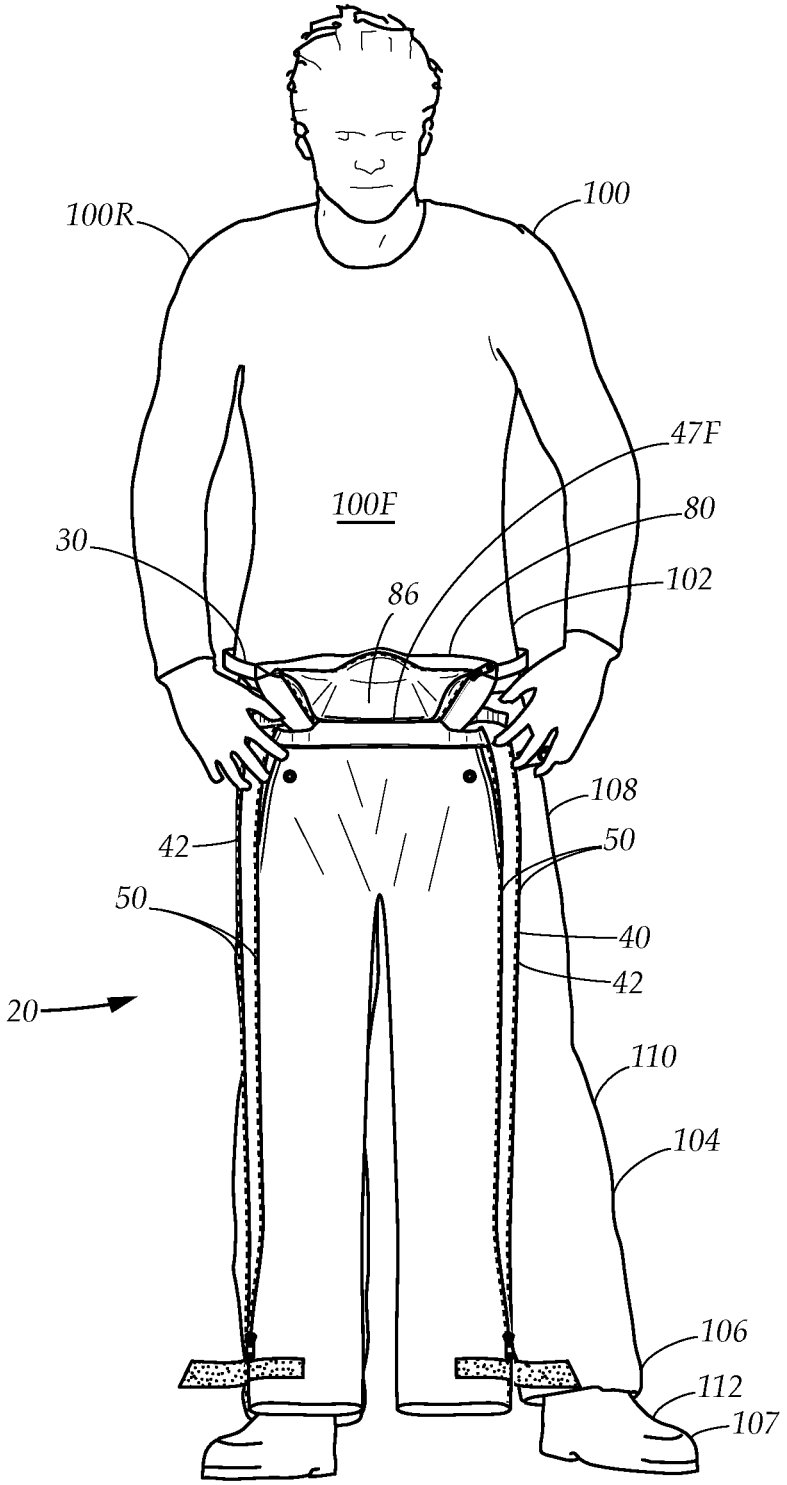
FIG. 6 is a front elevational view, illustrating the deployable pouch, wherein the pant portion is fully unfurled and the waist belt is attached around the waist of the user.

Referring now to FIG. 6, the deployable rain pant assembly 20 is being held by a user 100 having a waist 102, legs 104 having ankles 106 and feet 107, hips 108, a front 100F, and a 100R. The user is wearing everyday pants 110 and shoes 112, and the deployable rain pant assembly 20 is being held in front of the everyday pants 110. Note that typically the user 100 would attach the belt 30 around the waist 102 by clipping the mating buckles 37 of the buckle assembly (not shown). The pants portion 40 would initially be folded and stored in the storage pouch 80. The deployable rain pant assembly 20 could then be worn for an extended period of time, with the pants portion 40 stored in the pouch 80, while the user 100 engages in outdoor activities.

When it begins to rain, or protection of the user's everyday pants 110 is otherwise indicated, the pouch 80 is opened, the pants portion 40 may be rolled, unfolded, and or removed from the pouch 80 and extended downwardly from the belt 30 into the general configuration of FIG. 6, while the waist band front 47F remains attached to the interior surface 86 of the pouch 80. Note that the main seams 50 are fully open along the outer edges 42.

Figure 7:
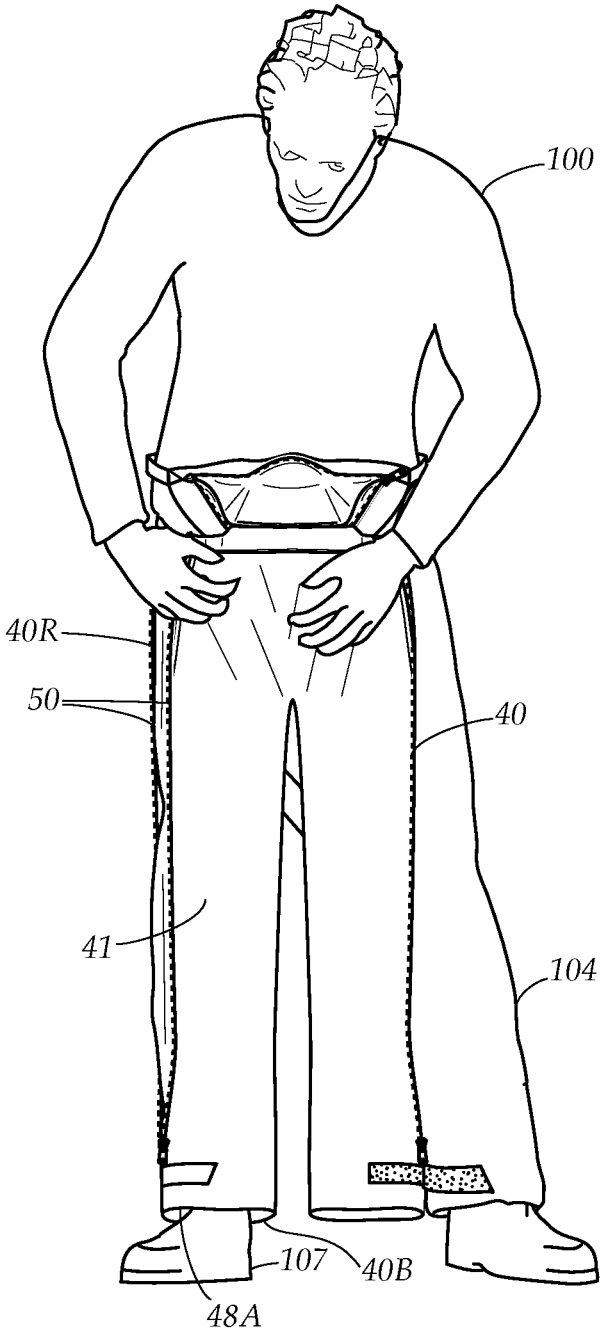
FIG. 7 is a front elevational view, similar to FIG. 6, except wherein the user has stepped one foot through one of the main seams and through one of the ankle openings.
Figure 8:
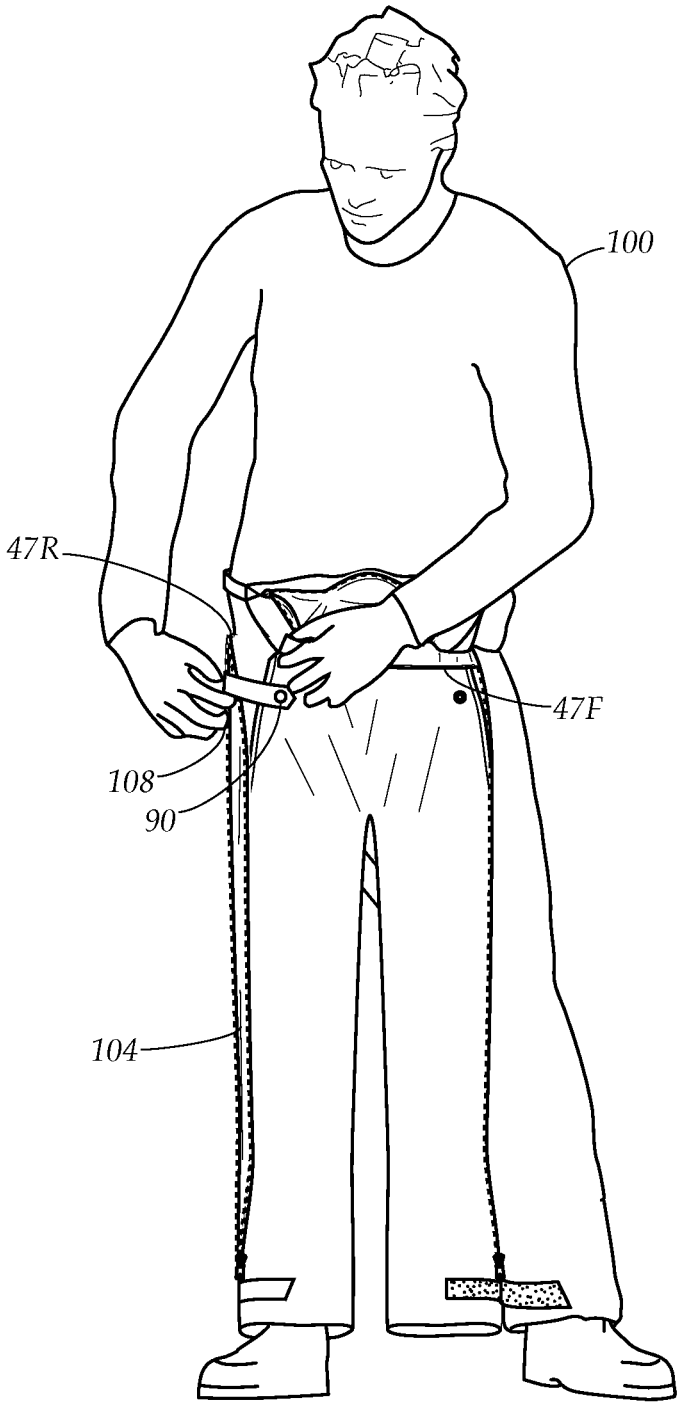
FIG. 8 is a front elevational view, similar to FIG. 7, except wherein the user has secured the waist band front to the waist band rear at one of his hips.

Referring now to FIG. 7, the user begins to don the pants portion 40 by stepping one foot 107 through the opening created by the main seam 50 and through the ankle opening 48A at the bottom edge 40B of one of the pant legs 41 while tucking much the rear 40R of the pants portion behind the user 100. Most importantly, the waist band rear 47R (not shown) must be tucked between the legs 104 and behind the user 100 at this point. Then referring to FIG. 8, the waist band rear 47R is pulled up behind the user 100 so that it is substantially the same height as the waist band front 47R. The waist band fasteners 90 are used to join the waist band front 47F and waist band rear 47R at the hip 108 associated with that leg 104 of the user 100.

Figure 9:
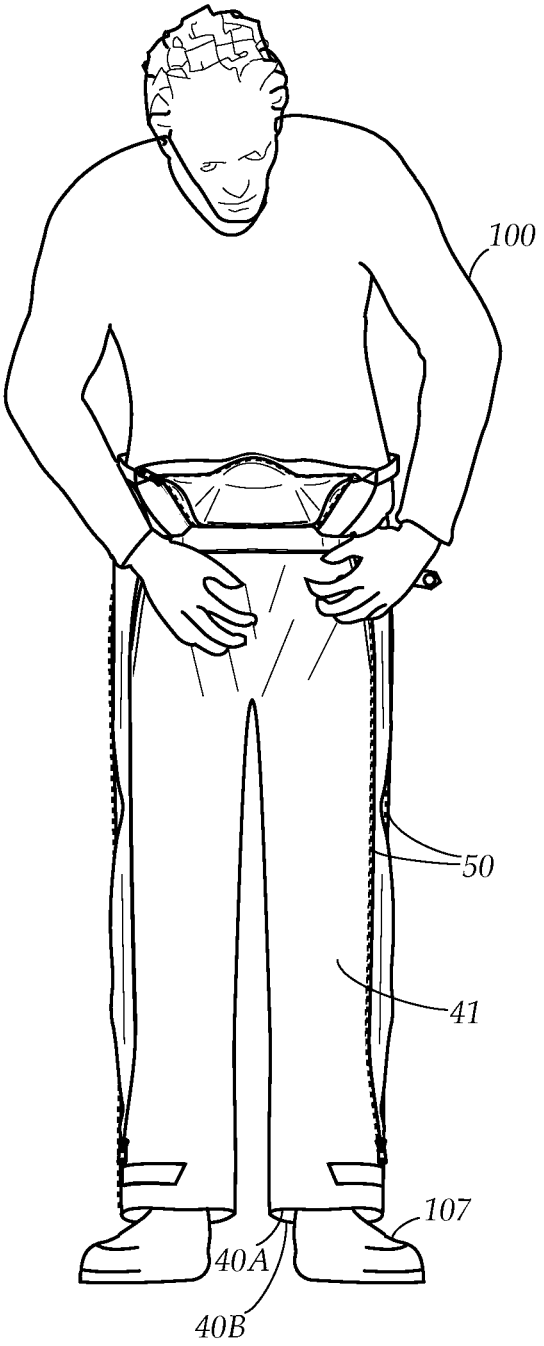
FIG. 9 is a front elevational view, similar to FIG. 8, except wherein the user has stepped the other foot through the other main seam and through the other of the ankle openings.
Figure 10:
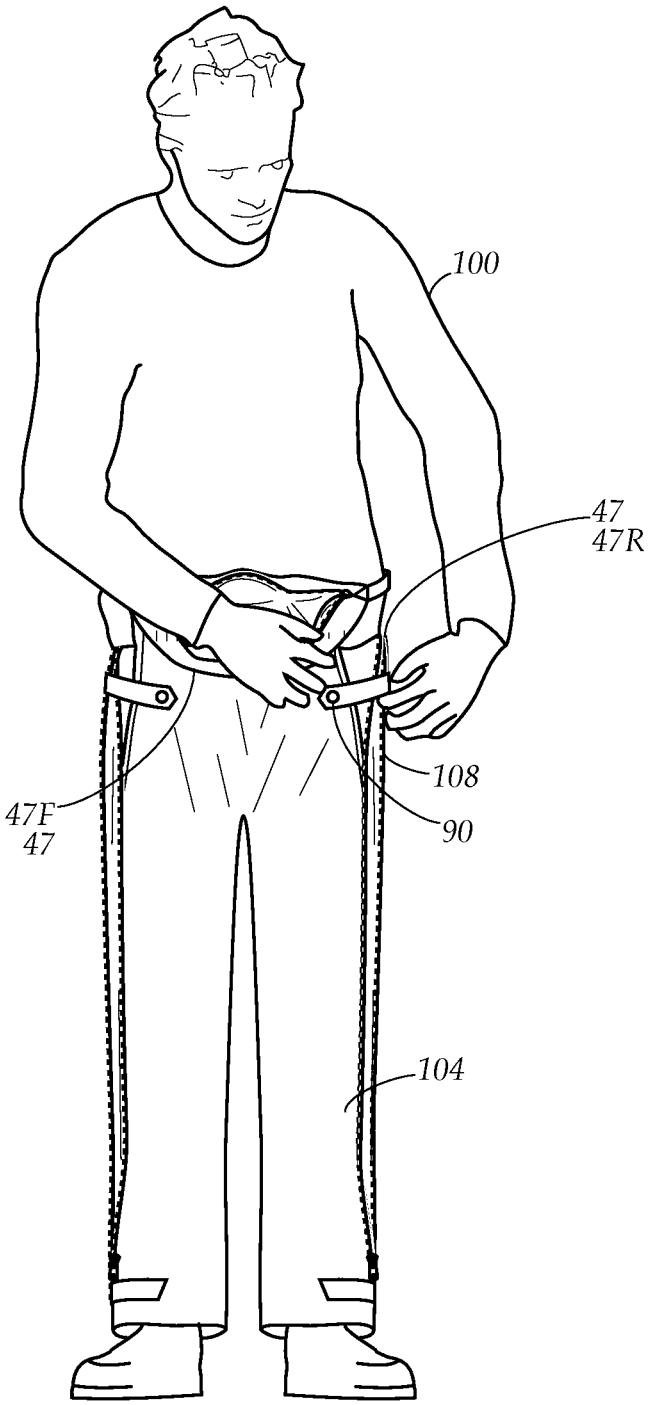
FIG. 10 is a front elevational view, similar to FIG. 9, except wherein the user has secured the waist band front to the waist band rear at the other of his hips.

Now, referring to FIG. 9, the user steps the other foot 107 through the opening created by the main seam 50 of the other pant leg 41 and stepping through the ankle opening 48A at the bottom edge 40B of that pant leg 41. Referring to FIG. 10, the waist band fasteners 90 can then be used to fully join the waist band front 47F and waist band rear 47R at the hip 108 associated with that leg 104 of the user 100. At this point, the waist band 47 is fully continuous around the user 100.

Figure 11:
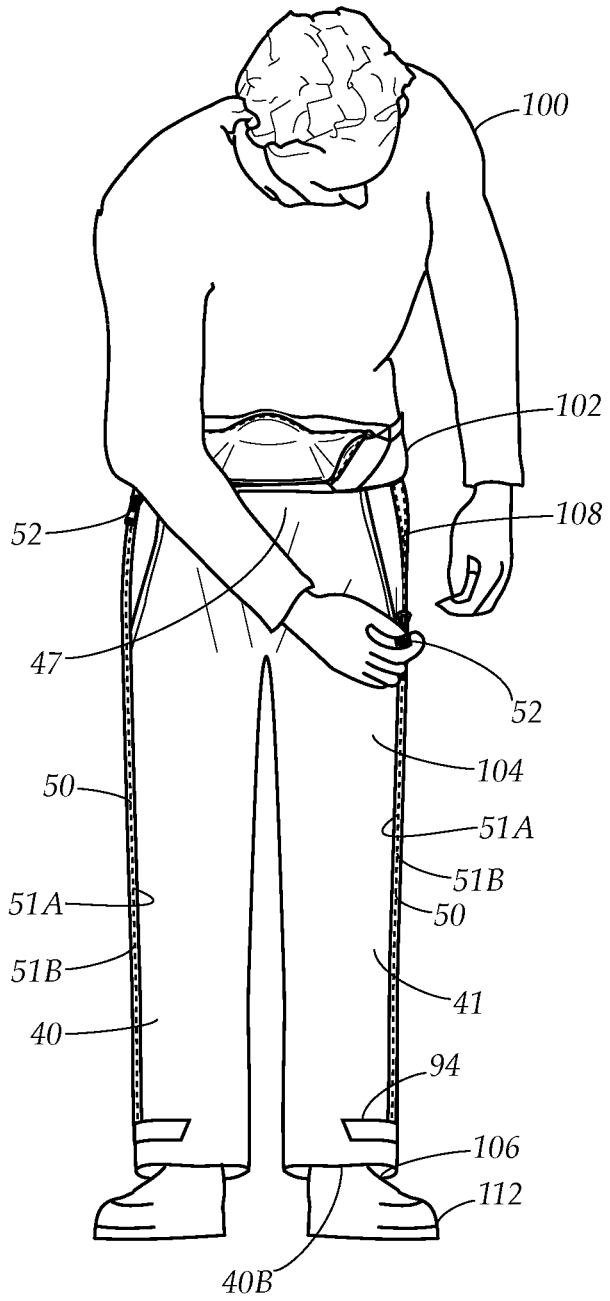
FIG. 11 is a front elevational view, similar to FIG. 10, except wherein the user has already closed one of the main seams and is closing the other of the main seams to fully encase the everyday pants within the pants portion of the deployable pants.

Finally, in FIG. 11, the user begins to join each of the main seams 50 by operating its associated main zipper 52, starting at the bottom edge 40B of one of the pant legs 41 to join its associated front outer seam edge 51A and rear outer seam edge 51B. Accordingly, the user starts zipping at the ankle 106, continues upwardly to the hip 108 associated with that leg 104, and fully to the waist band 47. With the main seams 50 fully joined, the pants portion 40 is effectively fastened around the user 100, substantially covering the everyday pants 110 (not shown) from waist 102 to ankles 106, without requiring the removal of the shoes 112 of the user 100. As illustrated, the cuff strap assembly 94 may be used to tighten the pant leg 41 around the user 100 near the bottom edge 40B.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a deployable rain pants assembly. The disclosure is illustrated by example in the drawing figures, and throughout the written description. It should be understood that numerous variations are possible, while adhering to the inventive concept. Such variations are contemplated as being a part of the present disclosure.

What is claimed is:

1. A deployable rain pants assembly, for use by a user having legs, a waist, and hips while wearing everyday pants and shoes, comprising:

a belt, having a buckle assembly having mating buckles adapted for fastening the belt around the waist of the user;

a pants portion, having a front, a rear, top edge, a bottom edge, a pair of pant legs, and a waist band having a selectively attachable and detachable waist band front and waist band rear, each pant leg having an outer edge and an inner edge, the outer edges of the pant legs face away from each other, the inner edges of the pant legs face toward each other, the pants portion having a pair of main seams, each main seam extending along the outer edge of one of the pant legs starting near the bottom edge, extending upwardly along said outer edge to the waist band, such that the main seams allow the pant legs of the pants portion to be fully separated along the outer edges between the waist band and nearly the bottom edge while remaining fastened only near the bottom edge and then may be selectively joined together to fasten the pants portion around the user; and a storage pouch attached to the belt and having a pouch opening, a pouch closure for selectively closing the pouch, and a pouch interior having a pouch interior surface that is enclosed within the pouch when the pouch closure is closed, the waist band front is attached to the pouch interior surface such that the pants portion may be selectively fully enclosed within the pouch interior and the pouch closure closed, and selectively rolled out from the pouch with the waist band front remaining attached to the pouch interior surface so that the pants portion is adapted to and can be donned by the user while the waist belt remains attached around the waist of the user.

2. The deployable rain pants assembly as recited in claim 1, wherein each pant leg has a front outer seam edge and a rear outer seam edge, wherein each main seam selectively connects one of the front outer seam edges and one of the rear outer seam edges, wherein the waist band includes a waist band front defined between the front outer seam edges, and a waist band rear defined between the rear outer seam edges, such that the waist band front and waist band rear join to make the waist band continuous.

3. The deployable rain pants assembly as recited in claim 2, wherein the pants portion includes a central portion, the inner edges of the pants portion are permanently attached to each other, the central portion and pant legs are connected through an inseam and along the inner edges of the pants portion.

4. The deployable rain pants assembly as recited in claim 3, further comprising waist band fasteners located adjacent to the main seams on the waist band front and waist band rear, for selectively securing the waist band front to the waist band rear as the main seams are joined together.

5. The deployable rain pants assembly as recited in claim 4, wherein each pant leg has an ankle opening and a cuff strap assembly near the bottom edge, the cuff strap assembly includes a cuff strap and a cuff fastener that may be selectively joined and is adapted to tighten the pant leg around the user near the bottom edge.

6. A deployable rain pants method, for use by a user having legs each having a foot, a waist, and ankles, for protecting everyday pants worn by the user from rain, using a deployable rain pants assembly having a belt, a pants portion, and a pouch fastened to the belt and having a pouch interior and pouch interior surface, the pants portion having a top edge, a bottom edge, a pair of pant legs each having an ankle opening near the bottom edge, and a waist band formed by a selectively attachable and detachable waist band front and a waist band rear, each pant leg having an outer edge and an inner edge, the outer edges of the pant legs face away from each other, the inner edges of the pant legs face toward each other, the pants portion having a pair of pant leg parts, a central portion, and a pair of main seams, each main seam extending along the outer edge of one of the pant legs starting near the bottom edge, extending upwardly along said outer edge to the waist band, such that the main seams allow the pant legs of the pants portion to be fully separated along the outer edges between the waist band and nearly the bottom edge while remaining fastened only near the bottom edge and then may be selectively joined together to fasten the pants portion around the user, further having a main seam fastener associated with each main seam, wherein the waist band includes a waist band front defined between the outer main seam edges, and a waist band rear defined between the central main seam edges, the waist band front attached to the pouch interior surface such that the pants portion is stored within the pouch interior, comprising the steps of:

removing the pants portion from the pouch while the waist band front remains attached to the pouch interior surface;

rolling the pants portion in front of the user downwardly from the waist toward the ankles;

stepping each foot through one of the ankle openings; and covering the everyday pants by fully encasing the legs by securing the main seams from the bottom edge to the waist band.

7. The deployable rain pants method as recited in claim 6, wherein the step of joining the pants legs parts to the central portion is preceded by the steps of:

i) raising the waist band rear to waist level behind the user, and ii) joining the waist band rear to the waist band front.

8. The deployable rain pants method as recited in claim 7, the pants portion having waist band fasteners located on the waist band front and waist band rear adjacent to the main seams, wherein the step of joining the waist band rear to the waist band front further comprises securing the waist band fasteners on the waist band rear to the waist band fasteners on the waist band front.

9. A deployable rain pants method, for use by a user having legs, a waist, and ankles, for protecting everyday pants worn by the user from rain, using a deployable rain pants assembly having a belt, a pants portion, and a pouch fastened to the belt and having a pouch interior and pouch interior surface, the pants portion having a top edge, a bottom edge, a pair of pant legs, and a waist band formed by a waist band front and a waist band rear, each pant leg having an outer edge and an inner edge, the outer edges of the pant legs face away from each other, the inner edges of the pant legs face toward each other, the pants portion having a pair of pant leg parts, a central portion, and a pair of main seams, each main seam extending along the outer edge of one of the pant legs starting near the bottom edge, extending upwardly along said outer edge to the waist band, such that the main seams allow the pant legs of the pants portion to be fully separated along the outer edges between the waist band and nearly the bottom edge while remaining fastened only near the bottom edge and then may be selectively joined together to fasten the pants portion around the user, further having a main seam fastener associated with each main seam, wherein the waist band includes a waist band front defined between the outer main seam edges, and a waist band rear defined between the central main seam edges, the waist band attached to the pouch interior surface such that the pants portion is stored within the pouch interior, comprising the steps of:

fastening the belt around the waist of the user;

unrolling the pants portion from the pouch interior while the waist band front remains attached to pouch interior surface;

deploying the pants portion in front of the user downwardly from the waist toward the ankles; and encasing the everyday pants by joining the waist band rear and waist band front by joining the front outer seam edges to the rear outer seam edges by moving the main seam fasteners upwardly from the bottom edge toward the waist band.

10. The deployable rain pants method as recited in claim 9, the pants portion having waist band fasteners located on the waist band front and waist band rear adjacent to the main seams, wherein the step of joining the waist band rear to the waist band front further comprises securing the waist band fasteners on the waist band rear to the waist band fasteners on the waist band front.

11. The deployable rain pants method as recited in claim 10, wherein the main seam fasteners are zippers, and wherein the step of joining the outer main seam edges to the central main seam edges further comprises zipping the main seam fasteners from the bottom edge of the pants portion to the top edge of the pants portion.

* * * * *